US011162674B1

(12) United States Patent
Larson

(10) Patent No.: US 11,162,674 B1
(45) Date of Patent: Nov. 2, 2021

(54) SYSTEMS, DEVICES, METHODS, AND COMPONENTS FOR ILLUMINATING SHOWER STALLS AND CLOSETS

(71) Applicant: Jesse D. Larson, Ramsey, MN (US)

(72) Inventor: Jesse D. Larson, Ramsey, MN (US)

( * ) Notice: Subject to any disclaimer, the term of this patent is extended or adjusted under 35 U.S.C. 154(b) by 0 days.

(21) Appl. No.: 16/265,834

(22) Filed: Feb. 1, 2019

Related U.S. Application Data

(60) Provisional application No. 62/625,059, filed on Feb. 1, 2018.

(51) Int. Cl.

| | |
|---|---|
| ***F21V 33/00*** | (2006.01) |
| ***F21L 4/02*** | (2006.01) |
| ***F21V 23/04*** | (2006.01) |
| ***A47H 1/022*** | (2006.01) |
| ***A47K 3/38*** | (2006.01) |
| ***F21Y 115/10*** | (2016.01) |
| ***A47H 1/02*** | (2006.01) |
| ***H04R 3/00*** | (2006.01) |
| ***H04R 1/02*** | (2006.01) |
| *F21Y 103/10* | (2016.01) |

(52) U.S. Cl.
CPC ..... *F21V 33/004* (2013.01); *A47H 1/022* (2013.01); *A47K 3/38* (2013.01); *F21L 4/02* (2013.01); *F21V 23/0442* (2013.01); *H04R 1/028* (2013.01); *H04R 3/00* (2013.01); *A47H 2001/0215* (2013.01); *F21Y 2103/10* (2016.08); *F21Y 2115/10* (2016.08); *H04R 2420/07* (2013.01)

(58) Field of Classification Search
CPC ... A47K 3/38; A47H 2001/0215; A47H 1/022
See application file for complete search history.

(56) References Cited

U.S. PATENT DOCUMENTS

| | | | | |
|---|---|---|---|---|
| 5,421,059 | A * | 6/1995 | Letters, Jr. | A47H 1/104 16/87.4 R |
| 9,267,650 | B2 * | 2/2016 | Simon | F21K 9/66 |
| 2008/0259615 | A1 * | 10/2008 | Chien | H04N 5/2354 362/382 |
| 2009/0119830 | A1 * | 5/2009 | Goskowski | A47K 3/38 4/610 |

(Continued)

*Primary Examiner* — Jong-Suk (James) Lee
*Assistant Examiner* — Eric T Eide
(74) *Attorney, Agent, or Firm* — Fantastic IP Consulting; Eduardo E. Drake

(57) ABSTRACT

Millions of homes across the world have shower stalls with poor illumination, not only creating additional risk of falls and other accidents and making cleaning of the shower more difficult, but also reducing enjoyment of the showering experience. Accordingly, the present inventor devised, among other things, an illuminated shower curtain rod assembly. One exemplary rod assembly, which is adjustable via screwing in or out one or both of its end caps, includes a elongated tension rod having one or more electric light elements distributed along the length. In some variations, the rod is extruded from aluminum or plastic and includes an extruded strip light support element that supports an LED strip light and enhances rigidity of the curtain rod. Also some embodiments integrate a light diffusion panel into the rod structure for enhanced illumination and aesthetic appeal.

20 Claims, 4 Drawing Sheets

(56) References Cited

U.S. PATENT DOCUMENTS

| | | | | |
|---|---|---|---|---|
| 2012/0212943 | A1* | 8/2012 | Stoltz | F21V 21/08 362/183 |
| 2014/0360805 | A1* | 12/2014 | Berkman | H04R 1/02 181/141 |
| 2016/0143486 | A1* | 5/2016 | Tsibulevskiy | A47K 3/38 29/428 |
| 2018/0135849 | A1* | 5/2018 | Paseta | F21V 33/004 |

* cited by examiner

SYSTEMS, DEVICES, METHODS, AND COMPONENTS FOR ILLUMINATING SHOWER STALLS AND CLOSETS

RELATED APPLICATION

The present application claims priority to U.S. Provisional Application 62/625,059 which was filed on Feb. 1, 2018, and which is incorporated herein by reference in its entirety.

COPYRIGHT NOTICE AND PERMISSION

A portion of this patent document contains material subject to copyright protection. The copyright owner has no objection to the facsimile reproduction by anyone of the patent document or the patent disclosure, as it appears in the patent and trademark office patent files or records, but otherwise reserves all copyrights whatsoever. The following notice applies to this document: Copyright © 2017, Jesse D. Larson

TECHNICAL FIELD

Various embodiments of the invention relate to lighting fixtures, particularly elongated fixtures suitable for shower and closet installations.

BACKGROUND

Millions of homes across the world have shower stalls with poor illumination. Shower stalls are often in bathrooms that have a single ceiling light to illuminate the entire bathroom. The height of a shower door or shower curtain often blocks much of the light from the ceiling light, leaving the shower stall with less than desirable illumination. Although additional lighting fixtures could be installed over the shower stalls, these generally require expensive and time consuming electrical wiring and drywall repair work.

Accordingly, the present inventor has recognized a need for faster and less expensive ways to improve the illumination of shower stalls and other spaces that have poor illumination.

SUMMARY

To address one or more of these and/or other needs or problems, the present inventor devised, among other things, one or more exemplary systems, kits, methods, devices, assemblies, components, for use in illuminating shower stalls and other spaces.

One exemplary embodiment takes the form of an elongated tension rod that includes one or more electric light elements distributed along the length of the rod and electrically coupled in parallel or in series with a battery box and a switch. The tension rod, in some embodiments, is configured to extend between two vertical support structures via a compression fit. In some embodiment, the ends of the rod may be supported via anchor fittings attached to the two vertical walls. Also, in some embodiments, the tension rod is of an adjustable length to allow custom fitting of the tension rod between vertical walls or other support structures.

In some embodiments, the electric light elements take the form of two or more LEDs, for example 30 or more, distributed along a flexible circuit board strip or tape. In some instances, an extruded support structure extends lengthwise through at least a portion of the length of a tube, with the support structure having a slot for receiving opposing edges of the flexible circuit board strip or tape.

Some embodiments further include a battery box and switch electrically coupled to the light elements. The battery box, in some embodiments, includes a hook for engaging with a curtain or clothing rod, and in others, an eyelet for engaging with existing curtain hooks or rings or other types of hangers.

In some embodiments, the battery box incudes other features such as a Bluetooth or WiFi speaker that can be paired with a smartphone. Other embodiments further include processing circuitry for controlling the color and transitioning lighting through desirable color display sequences.

BRIEF DESCRIPTION OF THE DRAWINGS

Various embodiments are described herein with reference to the following attached figures (Figs). These figures are annotated with reference numbers for various features and components, and these numbers are used in the following description as a teaching aid, with like numbers referring to the same or similar features and components.

DETAILED DESCRIPTION

This document, which incorporates drawings and claims, describes one or more specific embodiments of one or more inventions. These embodiments offered not to limit but only to exemplify and teach the invention, are shown and described in sufficient detail to enable those skilled in the art to implement or practice the invention(s). Thus, where appropriate to avoid obscuring the invention(s), the description may omit certain information known to those of skill in the art.

Figure 1:
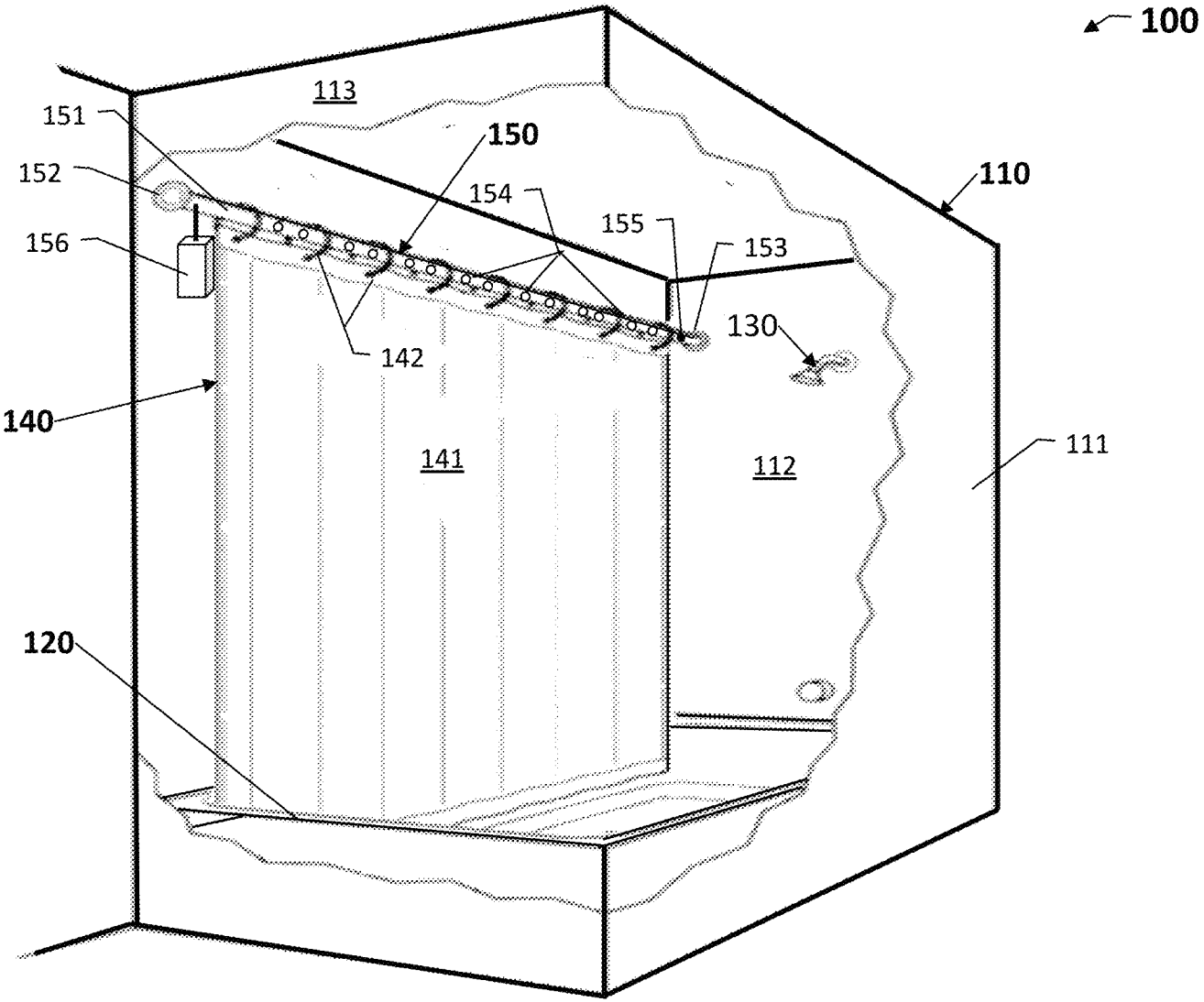
FIG. 1 is a perspective view of an illuminated shower stall or closet system, corresponding to one or more embodiments of the present invention.

FIG. 1 shows an exemplary illuminated shower stall assembly 100. Assembly 100 includes a stall structure 110, a tub 120, a showerhead 130, a shower curtain assembly 140, and an illuminated tension rod assembly 150. Stall structure 110 includes a generally vertical back wall 111 and respective left and right generally vertical support walls 112 and 113, which surround three sides of bathtub 120. Above bathtub 120 and supported by right support wall 112 is showerhead 130. Shower curtain assembly 140 includes curtain 141, which hangs via a set of hooks or loops 142 from adjustable illuminated tension rod assembly 150.

Illuminated tension rod assembly 150, which is supported via an interference fit between support walls 112 and 113, includes an illuminated plastic or metal rod or tube 151, end caps 152 and 153, and a set of electrical lights 154, a switch 155, and a battery box 156. Rod or tube 151 has two ends covered by end caps 152 and 153, which are in contact with respective vertical support walls 112 and 113. In some embodiments, tube 151 is substantially straight or curved, and the end caps are threadedly engaged with corresponding end portion of rod 153, enabling the end caps to be screwed outward or inward to determine an overall length of the rod assembly and a desired interference fit with walls 112 and 113.

Electrical lights 154, which for example take the form of LED (Light Emitting Diodes) are connected in series or parallel and distributed along the length of rod 151 between end caps 152 and 153. The lights are connected in series with switch 155 and terminals (not shown) of battery box 156. In some embodiments, switch 155, which is mounted to the rod, for example near or on end cap 153 or to the battery box, takes the form of a motion sensor, for example a passive infrared sensor, operating the lights in response to detecting IR changes induced by a human or water from the showerhead or faucet. Some embodiments may include a manual switch to override the motion detector.

Figure 2A:
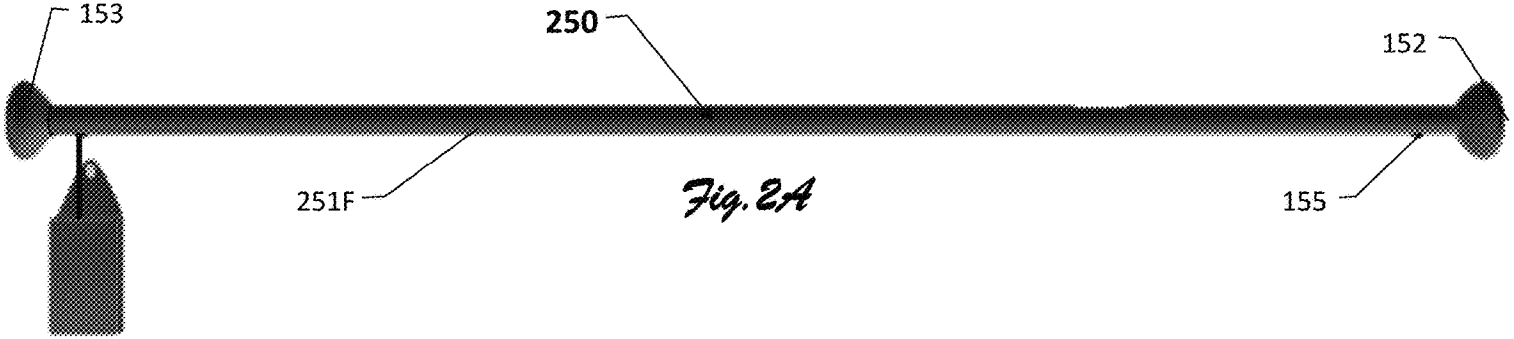
FIG. 2A is front view of an illuminated tension rod assembly for use in the FIG. 1 system, corresponding to one or more embodiments of the present invention.
Figure 2B:
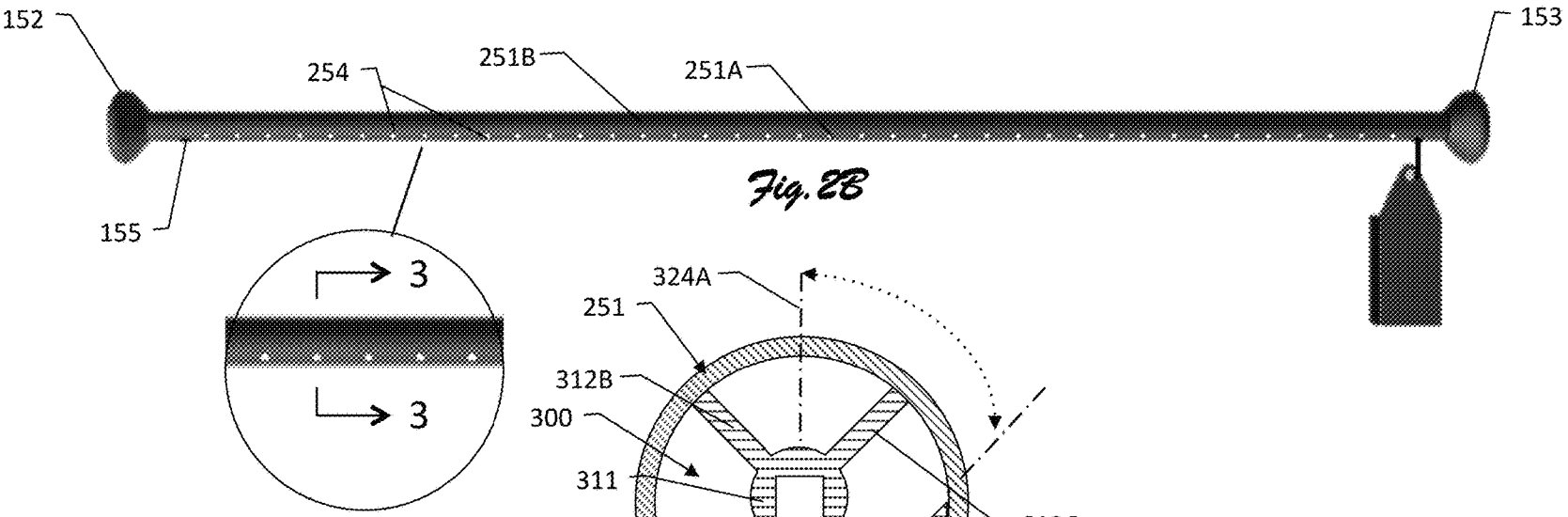
FIG. 2B is a back view of the illuminated tension rod assembly of FIG. 2A, corresponding to one or more embodiments of the invention.
Figure 3:
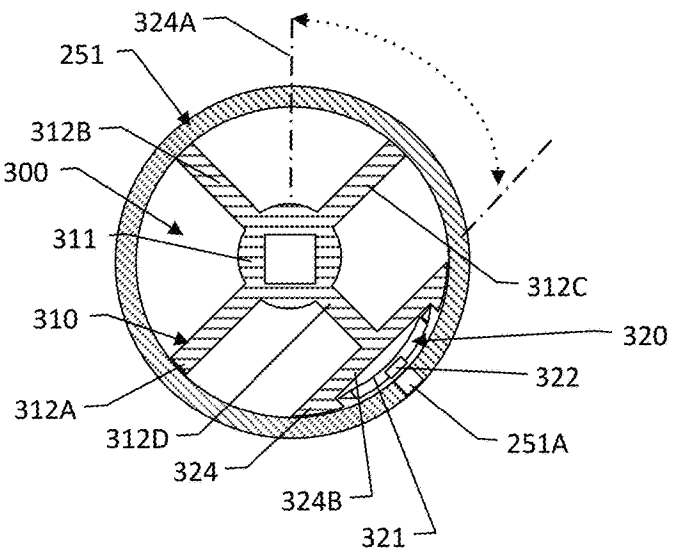
FIG. 3 is cross-sectional view of the tension rod assembly of FIG. 2, taken along line 3-3, corresponding to one or more embodiments of the invention.

FIGS. 2A, 2B, and 3 show an adjustable illuminated tension rod assembly 250 which may be used in place of tension rod assembly 150. FIG. 2A a front view of the tension rod assembly (the side facing away from the tub). includes a tension rod 251 having an aesthetically pleasing smooth front surface 251F. FIG. 2B, a back view of the assembly shows that back surface 251B of rod 251 includes a set of equispaced illumination holes or apertures 251A distributed along its length to allow passage of light from internally mounted electrical lights 254 into a shower stall or other adjacent area. (Some embodiments omit the apertures in place of a transparent or translucent plastic tube.) FIG. 3, a cross-sectional view of assembly 200 taken at line 3-3 in FIG. 2B, shows outer tubular structure of rod 251 with a representative illumination aperture 251A.

Within the hollow rod or tube is an extruded cross-and-channel light assembly 300 having an extruded aluminum or plastic cross-and-channel structure 310, and a LED light strip 320. Cross-and-channel structure 310 includes a central region 311, a set 312 of radial fins or flanges 312A, 312B, 312C, and 312D. The radial fins are spaced approximately 90-degrees apart from each other around the central region 311, which has a generally cylindrical exterior surface and a square interior hollow cross section. Flange 312D is terminated by a light strip mount channel 324 that is configured to retain and support light strip 320 such that its light elements are in proper registration with the illumination apertures, such as aperture 251A. Channel 324 is arranged perpendicular to radial flange 312D, with its base portion 324B defining an approximately 45-degree angle with vertical axis 324A. (Other embodiments generally provide an angle in the inclusive range of 30-60 degrees, for example, 30, 35, 40, 45, 50, 55, and 60 degrees, with some embodiments users may rotate the entire rod assembly or the rod independently of the end caps to alter the angle of illumination. Independent adjustment is achieved for example via a ratcheting mechanism or set screws for adjusting rotation of the rod.) Channel sidewalls 324C and 324D are generally parallel and spaced to form an interference fit with light strip 320, more precisely the edges of its flexible circuit board or substrate 321. Substrate 321 supports a series of lights, for example LEDs, of which light 322 is representative. A variety of light strips are used in various embodiments, with some including for example, 5- or 12-volt monochrome, RGB, and individually addressable LEDs. These may be distributed in various densities along the length of the strip, for example 30, 32, 60, and 120 LEDs per meter. In some embodiments the light strip is adhered to the channel base.

Figure 4A:
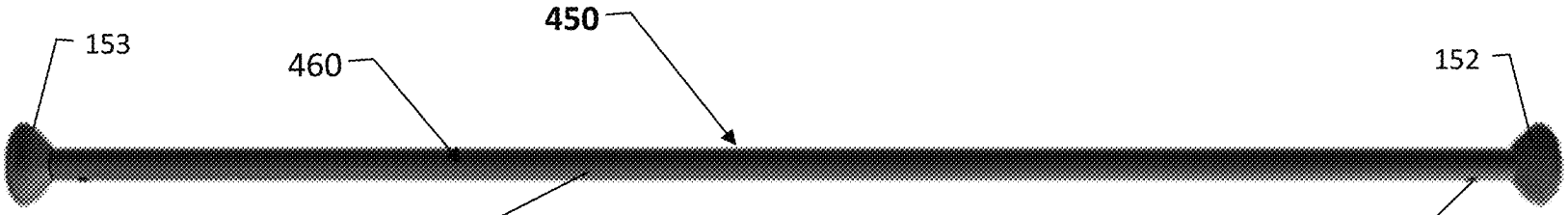
FIG. 4A is front view of another illuminated tension rod assembly for use in the FIG. 1 system, corresponding to one or more embodiments of the present invention.
Figure 4B:
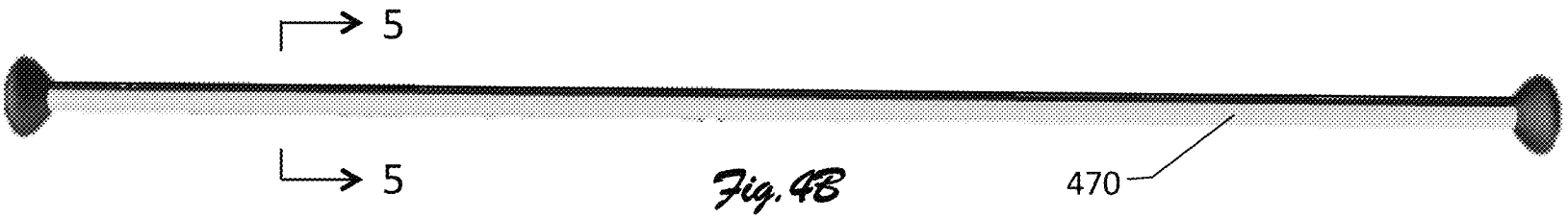
FIG. 4B is a back view of the illuminated tension rod assembly of FIG. 2A.
Figure 5:
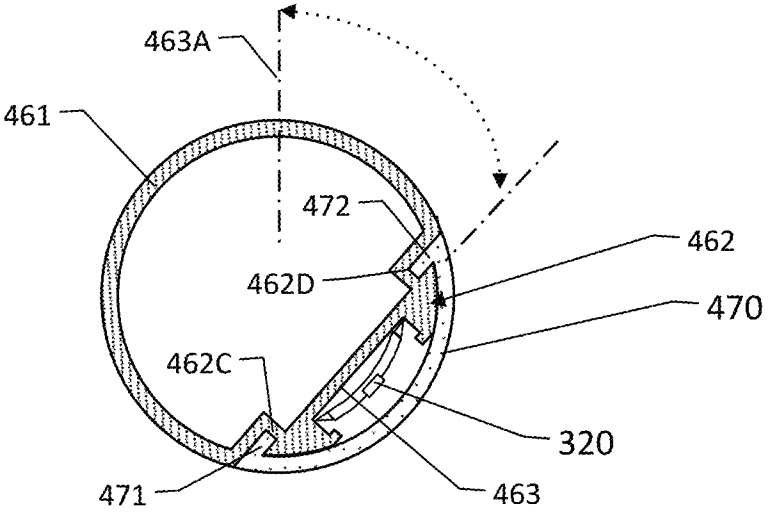
FIG. 5 is cross-sectional view of the tension rod assembly of FIGS. 3A and 3B, taken along line 4-4.

FIGS. 4A, 4B, and 5 show an adjustable illuminated tension rod assembly 450 which may also be used in place of illuminated tension rod assembly 150, with the same general functionality. FIG. 4A, a front view (the side facing away from the tub), shows that the assembly includes a rod or tube 460, which has an aesthetically pleasing smooth front surface 461F similar to surface 251F in FIG. 3A. FIG. 4B, a back view of the assembly, shows that the apertures in the FIG. 3B rod assembly have been replaced with a translucent light diffusion panel 470 that, in this embodiment, extends the full length of the rod structure between end caps 152 and 153 to diffuse light from internally mounted electrical lights 154 into the shower stall (or alcove, closet or other desired space). FIG. 5, a cross-sectional view of assembly 400 taken at line 5-5 in FIG. 4B, showing details of the rod 460 and its relationship to diffusion panel 470 and light strip 320.

In particular, the axial cross-section of rod assembly 460 includes a circumferential portion 461, a channel flange structure 462, and LED light strip 320. Circumferential portion 461 defines approximately 250-degrees of the rod's tubular cross-section, with channel flange structure 462 defining the remaining approximately 110 degrees. Channel flange structure 462 includes a channel portion 462B and opposing flange slots 462C and 462D, all of which run at least a majority of the length of the rod. Channel portion 462B supports and secures light strip 320 via an interference fit between opposing sidewalls of the channel or adhesive joint with a base of portion of the channel, similar to that described for assembly 200 in FIG. 3. The arrangement preferably orients the light strip at approximately 45 degrees relative to vertical axis 463A (which is generally parallel to the support walls of the shower stall). Opposing slots portions 462C and 462D that run the length of the rod and engage in a snap fit or interlocking slide fit with opposing flange portions 471 and 472 of diffusion panel 470.

Figure 6B:
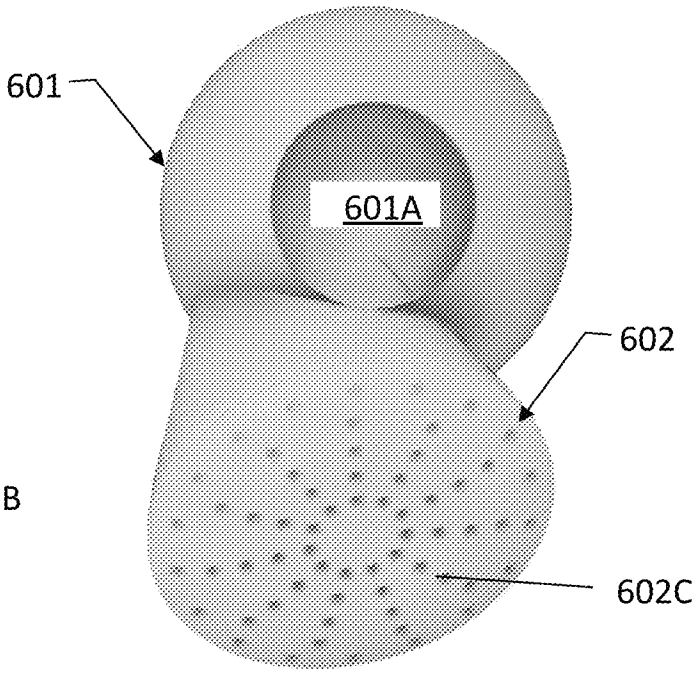
FIG. 6B is a side view of the FIG. 6A assembly, corresponding to one or more embodiments of the present invention.
Figure 6A:
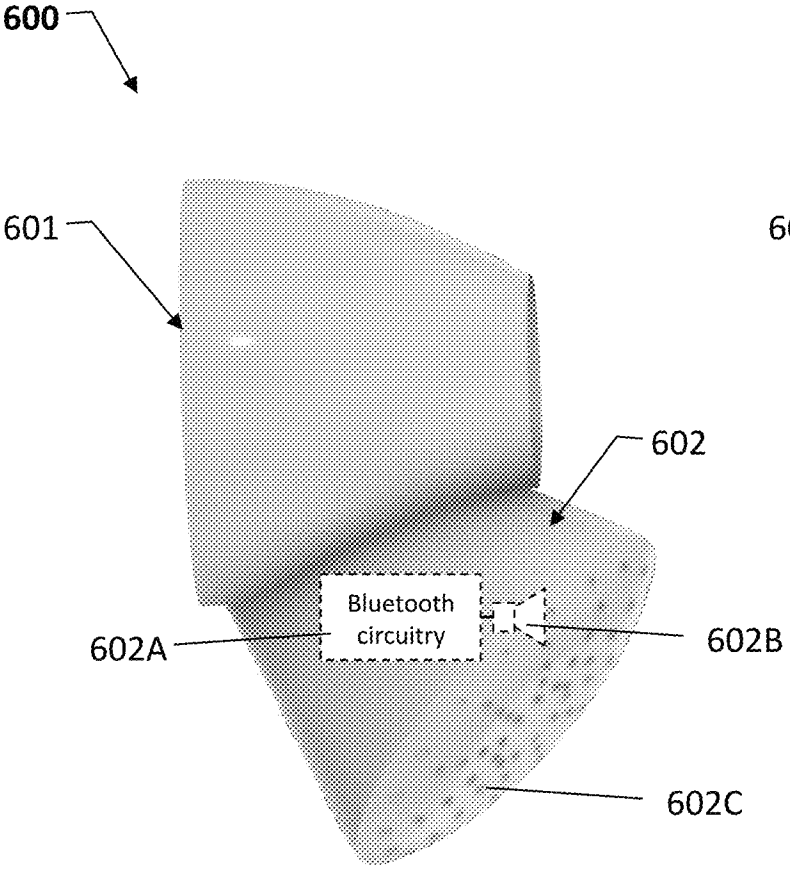
FIG. 6A is a front view of wireless end cap speaker assembly, corresponding to one or more embodiments of the present invention.

FIGS. 6A and 6B shows a wireless speaker end cap 600 which may be used in place of one or more of end caps 152 and 153 in any of the prior embodiments. End cap 600 includes an end cap portion 601 and a Bluetooth-compliant pairable wireless speaker portion 602. End cap portion 601, which includes a rod engagement hole or recess 601A, functions to facilitate a non-marring and/or non-marking compression fit of a tension rod between two supporting surfaces. Speaker portion 602, which includes Bluetooth circuitry module 602A, loud speaker 602B, and sound apertures 602C, functions to wireless receive and transduce wireless audio signals from a paired Bluetooth compliant device, such as an smartphone, tablet, laptop, personal stereo system, or voice responsive Artificial Intelligence device (not shown). In some embodiments, the Bluetooth compliant circuitry in the endcap has its own rechargeable battery, and in others the circuitry is powered via a direct connection to the battery box for the tension rod, which may be in some cases integrated within an adjacent end portion of an associated tension rod. U.S. Pat. No. 9,743,184 is incorporated herein by reference.

CONCLUSION

In the foregoing specification, specific exemplary embodiments have been described. However, one of ordinary skill in the art appreciates that various modifications and changes can be made without departing from the scope of the invention as set forth in the claims. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

Moreover in this document, relational terms, such as second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. The term "coupled" as used herein is defined as connected, although not necessarily directly and not necessarily mechanically. A device or structure that is "configured" in a certain way is configured in at least that way, but may also be configured in ways that are not listed. Also, the term "exemplary" is used as an adjective herein to modify one or more nouns, such as embodiment, system, method, device, and is meant to indicate specifically that the noun is provided as a non-limiting example.

What is claimed is:

1. A shower stall rod assembly configured for installation in a shower stall having two opposing vertical support surfaces, the assembly comprising:

an elongated support assembly having first and second end portions configured to engage with first and second vertical walls of a shower stall, the first and second ends defining a length dimension and the support assembly including a channel extending between the first and second end portions parallel to the length dimension, the channel having first and second opposing sidewalls;

an LED light strip extending between the first and second end portions parallel to the length dimension, and having a flexible substrate strip supporting an electrically coupled set of two or more LED lights, the strip having first and second opposing edge regions defining a width of the strip, with the first and second edge regions respectively engaging the first and second sidewalls of the channel to define an interference fit;

a battery box electrically coupled to the set of two or more LED lights and configured to be supported by the elongated support assembly;

a switch element electrically coupled to the set of LED lights and the battery box and configured to control operation of the LED lights.

2. The shower stall rod assembly of claim 1, wherein the elongated support assembly is configured to engage in a tension or compression fit between the first and second opposing vertical walls.

3. The shower stall rod assembly of claim 1, wherein the elongated support assembly comprises a cylindrical tube of aluminum, plastic, or other suitable rigid material, with the tube having substantially uniform inner and outer diameters along its entire length, at least partially containing the set of two or more LED lights, and having a set of apertures distributed along its length and positioned to allow passage of light from at least one of the LED lights from an interior of the tube to an exterior of the tube.

4. The shower stall assembly of claim 1, wherein the battery box is configured with a hook for engagement with a curtain or clothing rod, or an eyelet for engagement with a curtain hook member.

5. The shower stall assembly of claim 1, wherein the switch comprises a passive infrared detector.

6. The shower stall assembly of claim 5, wherein the passive infared is responsive to deactivation of a shower in the shower stall to deactivate the one or more of the LED lights a predetermined time period after perceived deactivation of the shower.

7. The shower stall assembly of claim 1, wherein the elongated support assembly includes a tubular portion and wherein the channel is part of an extruded metal or plastic channel structure, with the tubular portion having a set of two or more illumination apertures or slots distributed along its length and the extruded metal or plastic channel structure positioned within the tubular portion and configured to support the strip and hold two or more of the lights in registration with the two or more of the illumination apertures.

8. The shower stall assembly of claim 7, wherein the tubular structure is configured to orient the flexible substrate at a relative angle in the range of 30-60, inclusive, with a vertical reference.

9. The shower stall assembly of claim 1, wherein the channel is part of an extruded metal or plastic tubular structure having first and second opposing slot portions along at least a majority of its axial length, with the channel positioned between the first and second opposing slot portions, and wherein the shower stall assembly further includes an elongated and arcuate profiled light diffusion panel having first and second opposing flanges along its length dimension, with the first and second opposing flanges configured to mate respectively with the first and second slots of the tubular structure.

10. The shower stall assembly of claim 9, wherein the tubular structure is configured to orient the flexible substrate at a relative angle in the range of 30-60, inclusive, with a vertical reference angle.

11. The shower stall assembly of claim 1, wherein at least one of the end portions includes a wireless speaker circuit.

12. The shower stall assembly of claim 10, wherein at least one of the end portions includes a wireless speaker circuit.

13. A shower stall rod assembly configured for installation in a shower stall having two opposing vertical support surfaces, the assembly comprising:

an elongated support structure having first and second end portions configured to engage with first and second vertical walls of a shower stall, the first and second ends defining a length and a central axis, with the support structure having a generally circular cross-section with a chord-like flat portion offset from the central axis, the flat portion defining a generally flat support region that extends between the first and second end portions;

an LED light strip extending between the first and second end portions parallel to the length dimension, and having a flexible substrate strip having first and second opposing major surfaces, with the first major surface confronting the flat support region of the elongated structure and the second major surface supporting an electrically coupled set of two or more LED lights;

a battery box electrically coupled to the set of two or more LED lights and configured to be supported by the elongated support assembly; and a switch element electrically coupled to the set of LED lights and the battery box and configured to control operation of the LED lights.

14. The assembly of claim 13, wherein the flat support region includes a channel extending between the first and second end portions parallel to the length dimension, the channel having first and second opposing sidewalls, with the flexible substrate strip having first and second opposing edge regions defining a width of the substrate strip and with at least the first edge region contacting the first sidewall.

15. The assembly of claim 14, wherein the first and second edge regions respectively contact the first and second sidewalls to define an interference fit between the flexible substrate strip and the channel.

16. The assembly of claim 13:

wherein the flat support region is positioned between first and second opposing longitudinal slot portions; and wherein the assembly further includes an elongated and arcuate profiled light diffusion panel having first and second opposing flanges along its length dimension, with the first and second opposing flanges configured to mate respectively with the first and second slots of the tubular structure.

17. The assembly of claim 16, wherein the first and second opposing longitudinal slot portions are configured to orient the light diffusional panel at an acute angle relative to a vertical axis that is generally parallel to the support walls of the shower stall.

18. A shower stall rod assembly configured for installation in a shower stall having two opposing vertical support surfaces, the assembly comprising:

an elongated support structure having first and second end portions configured to engage with first and second vertical walls of a shower stall, the first and second ends defining a length dimension and a central axis, with the support structure having a longitudinal channel extending between the first and second end portions;

an LED light strip extending between the first and second end portions parallel to the length dimension and having a flexible substrate strip supporting an electrically coupled set of two or more LED lights, with the substrate strip engaged in an interference fit with the longitudinal channel;

a battery box electrically coupled to the set of two or more LED lights and configured to be supported by the elongated support assembly; and a switch element electrically coupled to the set of LED lights and the battery box and configured to control operation of the LED lights.

19. The assembly of claim 18, wherein the elongated support structure has a generally circular cross-section with a chord-like flat portion offset from the central axis, the flat portion defining a generally flat support region that includes the longitudinal channel, and wherein the longitudinal channel includes first and second opposing sidewalls that are spaced to engage in an interference fit with opposing edge regions of the LED light strip.

20. The shower stall assembly of claim 18, wherein at least one of the end portions includes a wireless speaker circuit.

* * * * *